US005925854A

United States Patent [19]

Sugiyama

[11] Patent Number: 5,925,854

[45] Date of Patent: Jul. 20, 1999

[54] INSULATING TERMINAL COVER WITH INTERNAL SECTIONS FOR PROHIBITING ROTATION

[75] Inventor: Norio Sugiyama, Shizuoka, Japan

[73] Assignee: Yazaki Corporation, Tokyo, Japan

[21] Appl. No.: 08/738,066

[22] Filed: Oct. 25, 1996

[30] Foreign Application Priority Data

Oct. 27, 1995 [JP] Japan ..... 7-280703

[51] Int. Cl.[6] ..... H01B 17/00

[52] U.S. Cl. ..... 174/138 F; 429/65

[58] Field of Search ..... 174/138 F, 139, 174/5 R, 74 A, 135; 429/65, 121; 439/522, 523, 521; D13/156

[56] References Cited

U.S. PATENT DOCUMENTS

| | | | |
|---|---|---|---|
| 2,538,483 | 1/1951 | Summers | 411/374 |
| 4,643,924 | 2/1987 | Uken et al. | 428/35.7 |
| 4,921,443 | 5/1990 | Sato | 439/521 |
| 5,346,408 | 9/1994 | Chupak | 439/522 |

FOREIGN PATENT DOCUMENTS

| | | |
|---|---|---|
| 4-51770 | 4/1992 | Japan . |
| 7-85858 | 3/1995 | Japan . |

*Primary Examiner*—Kristine L. Kincaid
*Assistant Examiner*—Kamand Cuneo
*Attorney, Agent, or Firm*—Sughrue, Mion, Zinn, Macpeak & Seas, PLLC

[57] ABSTRACT

An injector insulating cover includes a circumferential engagement portion in an inner wall portion. The circumferential engagement portion is engaged in a circumferential direction with respective apexes of a nut portion disposed in a head portion of an injector. When the insulating cover is attached so as to cover the head portion of the injector, the insulating cover cannot relatively rotate about the axis of the injector. Thus, the insulating cover can surely hold electric wires connected to terminals of the injector, so that electric wires elongate in a desired direction, and disadvantages such as that the electric wires come in contact with peripheral components and their insulating sheaths are damaged can be prevented from being produced.

3 Claims, 5 Drawing Sheets

INSULATING TERMINAL COVER WITH INTERNAL SECTIONS FOR PROHIBITING ROTATION

BACKGROUND OF THE INVENTION

The present invention relates to an insulating terminal cover, and particularly to an improvement of an injector insulating cover for an injector which ejects fuel into an engine. Such an insulating cover is fitted onto a head portion of the injector, covers and insulates a wire connecting portion in a head portion of the injector, and holds and fixes an electric wire connected to the wire connecting portion so that the electric wire elongates in a desired direction.

For example, an injector for ejecting fuel into a cylinder is attached to a cylinder head of a diesel engine. Electric wires which elongate from a control apparatus for controlling the operation of the injector are connected to a wire connecting portion disposed in a head portion of the injector. A portion of the wire connecting portion of the injector to which the electric wires are connected is covered with an insulating cover which is an insulating terminal cover, so that a leakage of electricity from the wire connecting portion is prevented from occurring.

All example of the structure of a portion in which such an insulating cover is attached to the injector will be described with reference to FIG. 8. A nut portion 2 is formed in a head portion of an injector 1. The nut portion 2 is a hexagonal tool engagement portion and with which a tightening tool such as a wrench is engaged when the injector 1 is screwed into an engine and fixed thereto. A disk-like flange 3 is formed below the nut portion 2. A connection piece 6 connected to an end portion of an electric wire 5 is attached by means of a nut 7 to each of a pair of terminals 4 which are protruded in the head portion of the injector 1 and function as wire connecting portions.

An insulating cover 300 which is to be fitted onto the head portion of the injector 1 has a body portion 8 having a substantially cylindrical shape, and a wire holding portion 9 which is continuously integrated with the body portion 8. When the body portion 8 is fitted onto the head portion of the injector 1, a plurality of engagement pawls 10 protruded from an inner periphery of the body portion 8 are engaged with the lower face of the flange 3. Therefore, the insulating cover 300 is held in an axial direction so as not to fall out of the head portion of the injector 1. The electric wires 5 which are connected to the terminals 4 of the injector 1 are held by the wire holding portion 9 of the insulating cover 300, so as not to come into contact with the engine body.

The above-described conventional insulating cover 300 is fitted onto the disk-like flange 3 disposed in the head portion of the injector 1, and the engagement pawls 10 are engaged with the lower face of the flange 3. In this construction, the insulating cover 300 can freely rotate about the axis of the injector 1 as indicated by arrows in FIG. 9.

The conventional insulating cover 300 has no problem in covering the head portion of the injector 1 for insulation. However, the insulating cover 300 involves a drawback in a function of holding the electric wires 5 so as to elongate in a desired direction. Specifically, if the other end portion of one of the electric wires 5 is pulled as a result of the leading conditions of the electric wire 5, the insulating cover 300 rotates, so that the insulating cover 300 cannot hold the electric wire 5 in a desired direction. As a result, the electric wire 5 comes in contact with other portions such as the engine, thereby producing a possibility that the insulating cover may be dropped off by vibration or the like, or the electric wire sheath may be broken.

SUMMARY OF THE INVENTION

It is an object of the invention to solve the above-discussed problem, and to provide a superior insulating terminal cover which cannot relatively rotate about an axis with respect to a head portion of a cylindrical terminal body, and which can surely hold an electric wire connected to a wire connecting portion in such a manner the electric wire elongates in a desired direction.

The object of the invention can be attained by an insulating terminal cover which is to be attached to a head portion of a cylindrical terminal body and cover a nut portion and a wire connecting portion in the head portion of the cylindrical terminal body fastened to a portion to be mounted, wherein an inner wall portion of the insulating terminal cover is engaged with a top portion of an outer periphery of the nut portion, and the insulating terminal cover can hold a leading position of an electric wire with respect to the cylindrical terminal body.

The insulating terminal cover of the invention is engaged with the nut portion of the cylindrical terminal body in a circumferential direction, and hence cannot relatively rotate about the axis with respect to the head portion of the cylindrical terminal body. Accordingly, the electric wire connected to the cylindrical terminal body can be surely held so as to elongate in a desired direction.

DETAILED DESCRIPTION OF THE INVENTION

Hereinafter, preferred embodiments of the insulating terminal cover of the invention will be described in detail with reference to the accompanying drawings.

Figure 1:
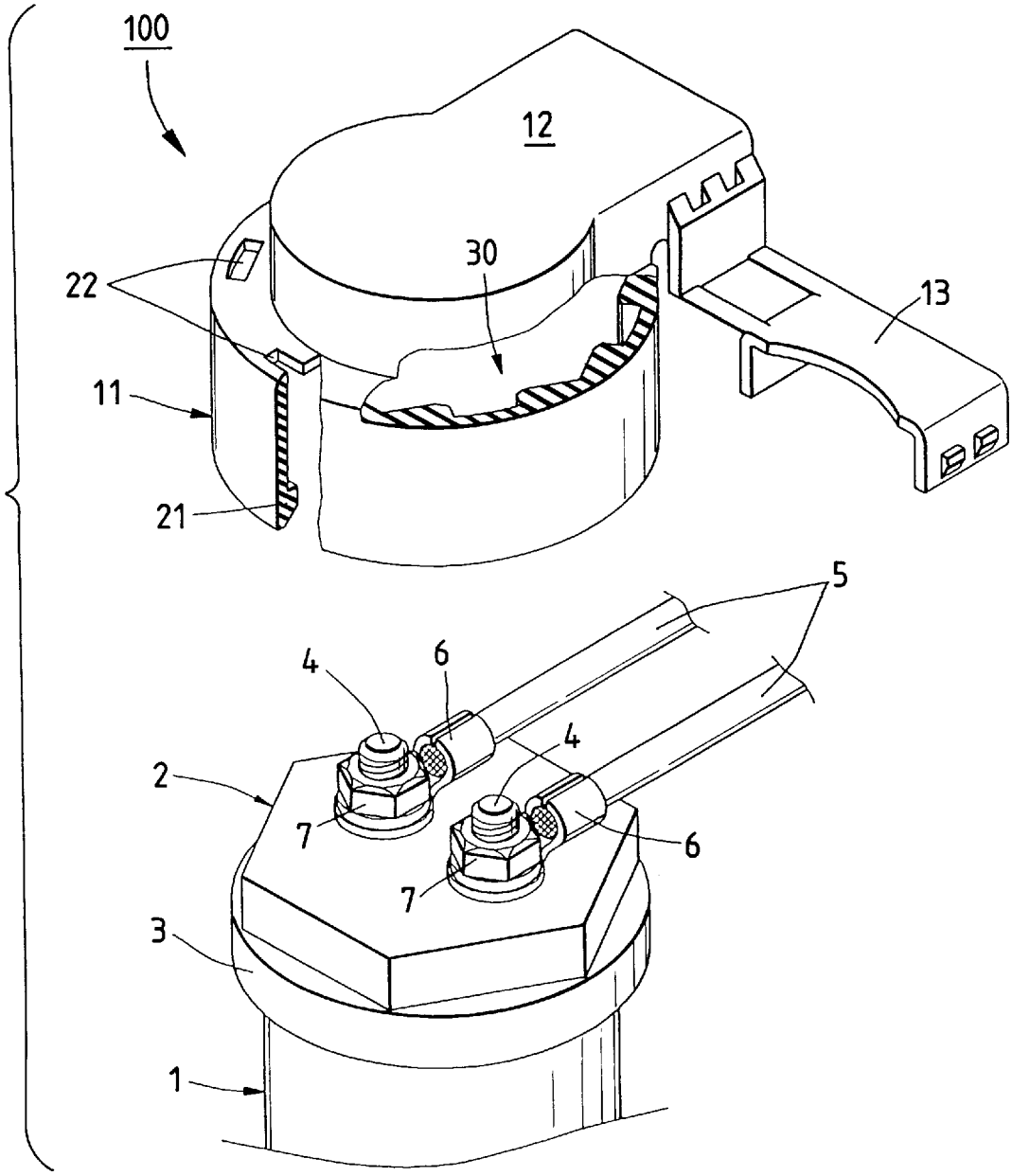
FIG. 1 is an enlarged perspective view of main portions showing an injector insulating cover of a first embodiment of the invention, and an injector.

Referring to FIG. 1, an injector 1 which serves as a cylindrical terminal body and to which an injector insulating cover 100, which is an insulating terminal cover of a first embodiment, is to be attached will be described. A nut portion 2 is formed in a head portion of the injector 1. The nut portion 2 is a tool engagement portion having a hexagonal prism-like shape. When the injector 1 is screwed into and tightly fixed to a female screw hole (not shown) bored in a cylinder head or the like of an engine which is the portion to be mounted, the nut portion 2 is to be engaged with a tightening tool such as a hexagonal wrench. A disk-like flange 3 is formed below the nut portion 2. Connection pieces 6 connected to end portions of a pair of electric wires 5 for supplying a control current to the injector 1 are secured by means of tightening nuts 7 to a pair of terminals 4 which serve as the wire connecting portion and which are protruded from the head portion of the injector 1, i.e., the upper face of the nut portion 2.

Figure 2:
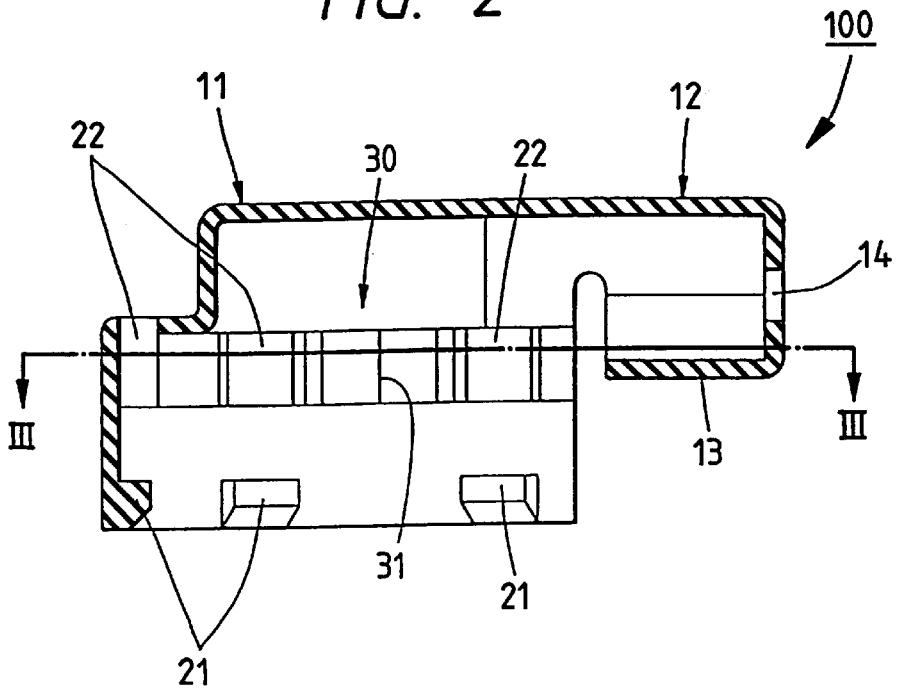
FIG. 2 is a vertical sectional view of the injector insulating cover shown in FIG. 1.
Figure 3:
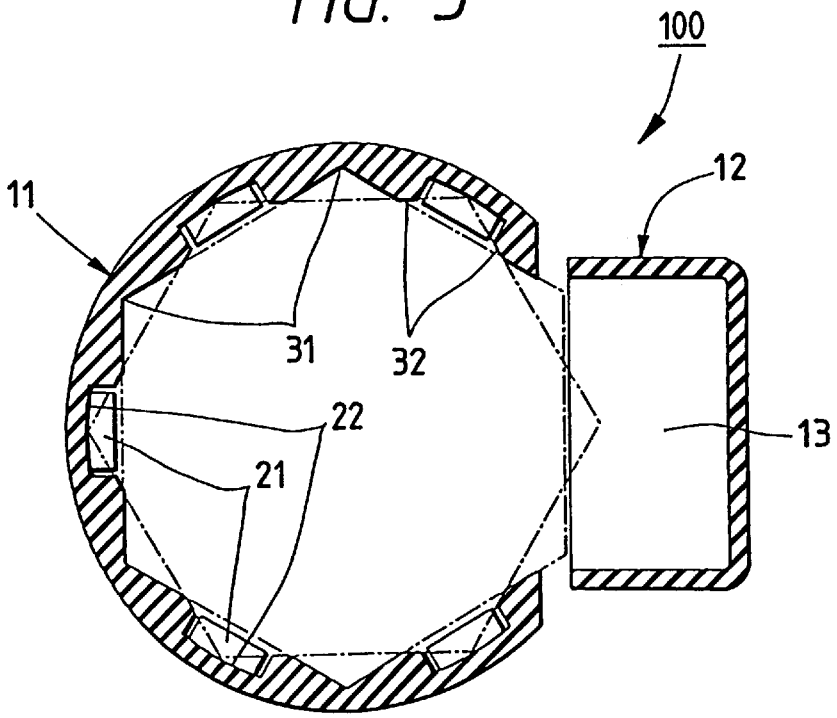
FIG. 3 is a sectional view taken along a line III—III in FIG. 2.

The insulating cover 100 which is fitted onto the head portion of the injector 1 is a component which is formed by injection molding of an insulating resin material. As shown in FIGS. 1 to 3, the insulating cover 100 comprises a cylindrical body portion 11 having a bottom and substantially having a step, and a wire holding portion 12 with a smaller diameter portion than said body portion which is continuously integrated with the body portion 11.

The larger diameter portion of the body portion 11 can be fitted onto the nut portion 2 and the flange 3 of the injector 1. The smaller diameter portion is configured so as to house the terminals 4, the connection pieces 6, and the tightening nuts 7.

The wire holding portion 12 is integrally formed so as to externally elongate in a radial direction with respect to the body portion 11. The wire holding portion 12 is divided into upper and lower portions. A lower cover 13 which is connected to the upper portion via a hinged portion is engaged with a lower part of the upper portion, so that a wire holding hole 14 for holding and fixing the electric wires 5 is formed.

At the lower end of an inner periphery of the larger diameter portion of the body portion 11, five engagement pawls 21 in total are protrudingly arranged in a circumferential direction at regular intervals of 60 degrees. The engagement pawls 21 are engaged with the lower face of the flange 3 of the injector 1, so as to detachably hold the insulating cover 100 in the axial direction with respect to the injector 1. In order to form undercut portions of the engagement pawls 21, slide pins are used during manufacturing. As a result five projection-forming openings 22 are formed by the slide pins which are incorporated in an injection mold so as to be slidably disposed in the axial direction of the body portion 11 of the insulating cover 100, which are opposed to the engagement pawls 21 in the axial direction.

On the other hand, in an upper end portion of the inner periphery of the larger diameter portion which serves as the inner wall portion of the body portion 11, a circumferential engagement portion 30 which is to be engaged in a circumferential direction with apexes 2*a* of the outer periphery of the nut portion 2 of the injector 1 is formed.

Figure 4:
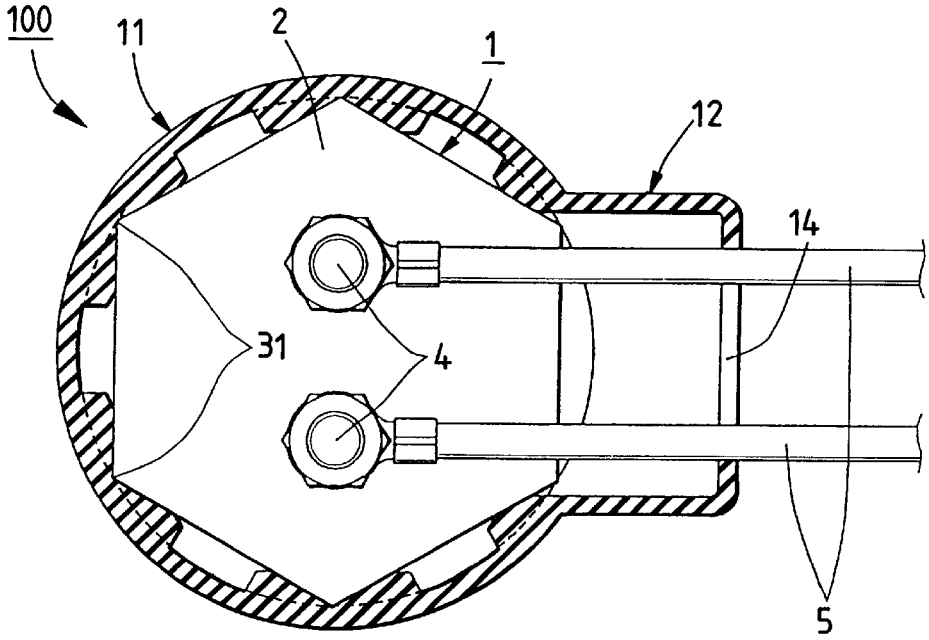
FIG. 4 is a horizontal sectional view illustrating a condition in which the injector insulating cover shown in FIG. 1 is attached to the injector.

In the circumferential engagement portion 30, as shown in the sectional view of FIG. 3 taken in the direction of the arrow of FIG. 2, five corner portions 31 in total which are to be fitted to the respective apexes 2*a* of the nut portion 2 are disposed at pitches of 60 degrees in such a manner that they are displaced by 30 degrees in the circumferential direction with respect to the respective projection-forming openings 22. As shown in FIG. 4, when the insulating cover 100 is fitted onto the head portion of the injector 1 so that the corner portions 31 are fitted to the respective apexes 2*a* of the nut portion 2, the insulating cover 100 is engagingly held so as not to rotate about the axis of the injector 1.

Figure 5:
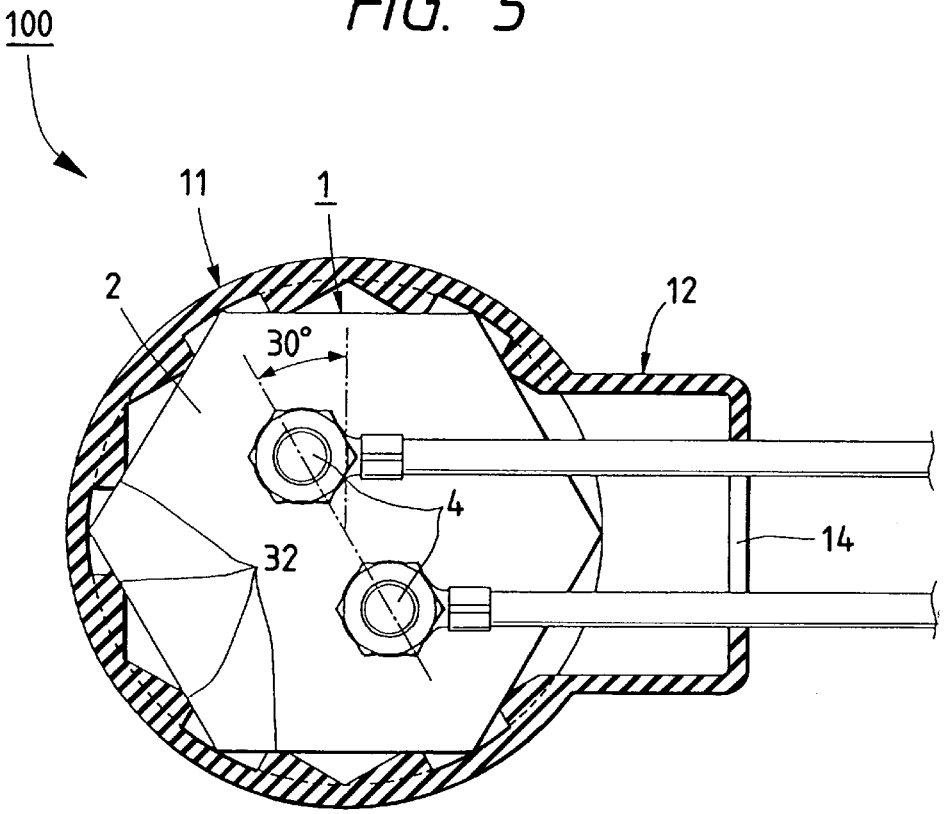
FIG. 5 is a horizontal sectional view illustrating another condition in which the injector insulating cover shown in FIG. 1 is attached to the injector.

In addition, as shown in FIG. 3, in each of the end portions in the circumferential direction of each of the projection-forming openings 22, a chamfer 32 is formed so as to be capable of being closely in contact with the corresponding side face of the nut portion 2. As shown in FIG. 5, the insulating cover 100 is engagingly held so as not to rotate about the axis of the injector 1, also by fitting the insulating cover 100 onto the head portion of the injector 1 so that the chamfers 32 are closely in contact with the respective side faces of the nut portion 2.

As described above, in the circumferential engagement portion 30 of the injector insulating cover 100 of the first embodiment, the corner portions 31 and the chamfers 32 formed in the projection-forming openings 22 are disposed so that they are mutually arranged with intervals of 30 degrees in the circumferential direction. Accordingly, the injector insulating cover 100 of the first embodiment can be attached to the injector 1 with an angular pitch of 30 degrees around the axis of the injector 1.

According to the injector insulating cover 100 of the first embodiment, when the injector 1 is screwed into and attached to the engine, the electric wires 5 can be held by the wire holding portion 12 so as to project within a range of ±30 degrees with respect to a desired direction, and without respect to the positions of the terminals 4 of the injector 1 in the circumferential direction as shown in FIG. 5.

Consequently, irrespective of the leading conditions of the electric wires 5 in the engine room, the electric wires 5 are free from disadvantages such as that the electric wires come into contact with peripheral components and their insulating sheaths are damaged.

Figure 6:
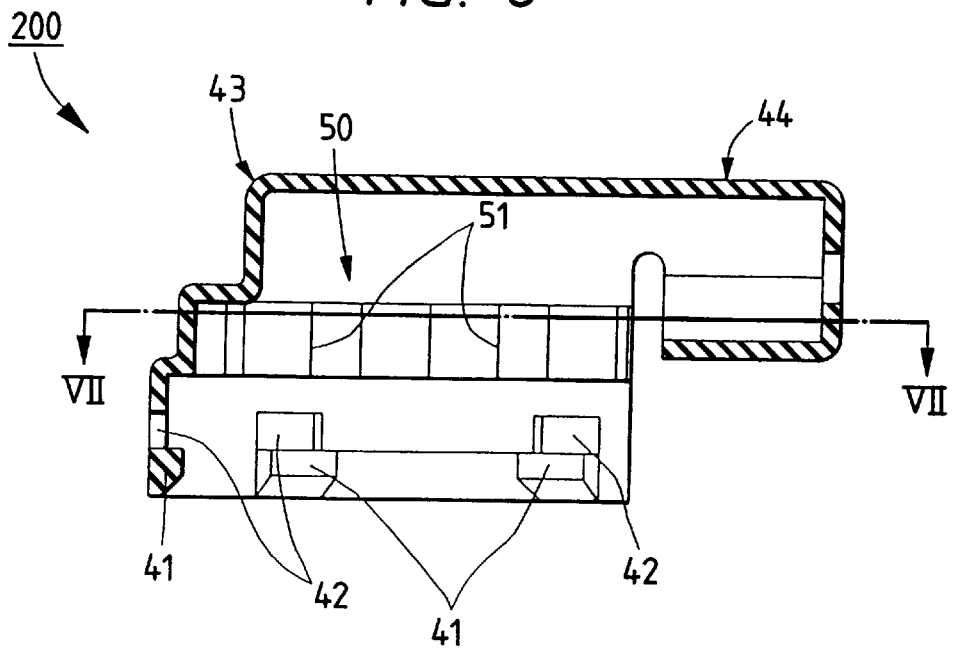
FIG. 6 is a vertical sectional view of an injector insulating cover of a second embodiment of the invention.

In the above-described injector insulating cover 100 of the first embodiment, the circumferential engagement portion 30 is formed by using the corner portions 31 and the chamfers 32 of the projection-forming openings 22 formed in the body portion 11. By contrast, an injector insulating cover 200 which is shown in FIGS. 6 and 7 and an insulating terminal cover of a second embodiment of the invention is improved so that the whole of a circumferential engagement portion 50 is formed by corner portions 51 which correspond to apexes 2*a* of a nut portion 2 and areas for engagement with the respective apexes 2*a* in the circumferential direction can be always set to be large.

The insulating cover 200 is a component which is formed by injection molding of an insulating resin material. As shown in FIG. 6, the insulating cover 200 comprises a cylindrical body portion 43 having a bottom and substantially having a step, and a wire holding portion 44 which is continuously integrated with the body portion 43. At the lower end of an inner periphery of the larger diameter portion of the body portion 43, engagement pawls 41 are protrudingly arranged at regular pitches of 60 degrees in the circumferential direction. The engagement pawls 41 are engaged with the lower face of the flange 3 of the injector 1, so as to detachably hold the insulating cover 200 to the injector 1 in the axial direction.

In an injection mold for forming the injector insulating cover 200 of the second embodiment, slide pins are used for forming undercut portions of the engagement pawls 41 for holding the insulating cover 200 to the injector 1 in the axial direction. In this case, the slide pins are incorporated so as to be slidable in a radial direction. Thus, projection forming holes 42 are formed in the insulating cover 200 by the slide pins to elongate in a radial direction just above the engagement pawls 41, as shown in FIGS. 6 and 7.

Figure 7:
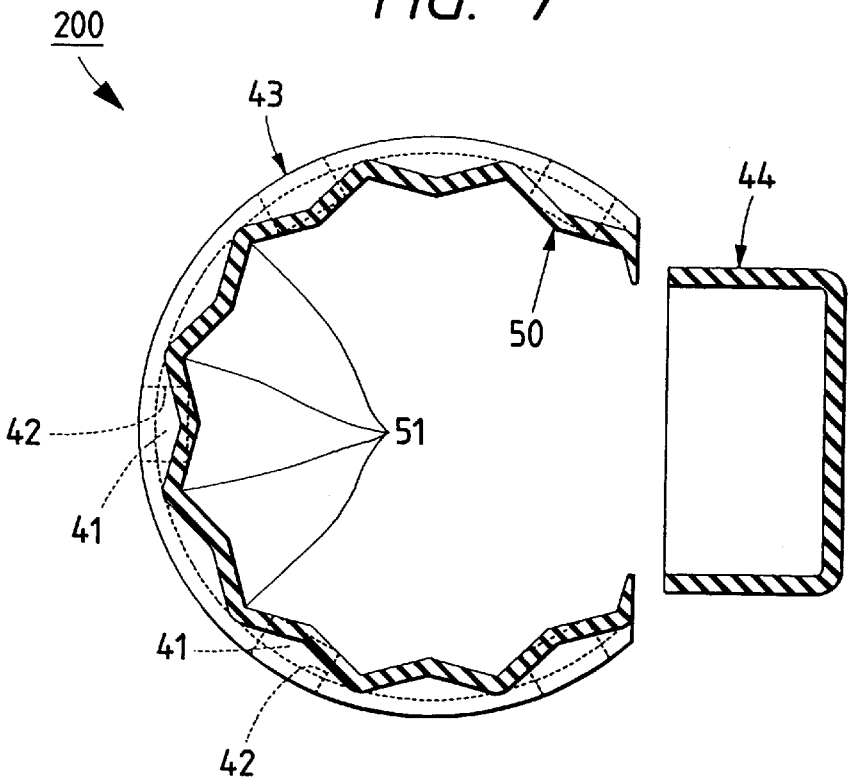
FIG. 7 is a sectional view taken along a line VII—VII in FIG. 6.
Figure 8:
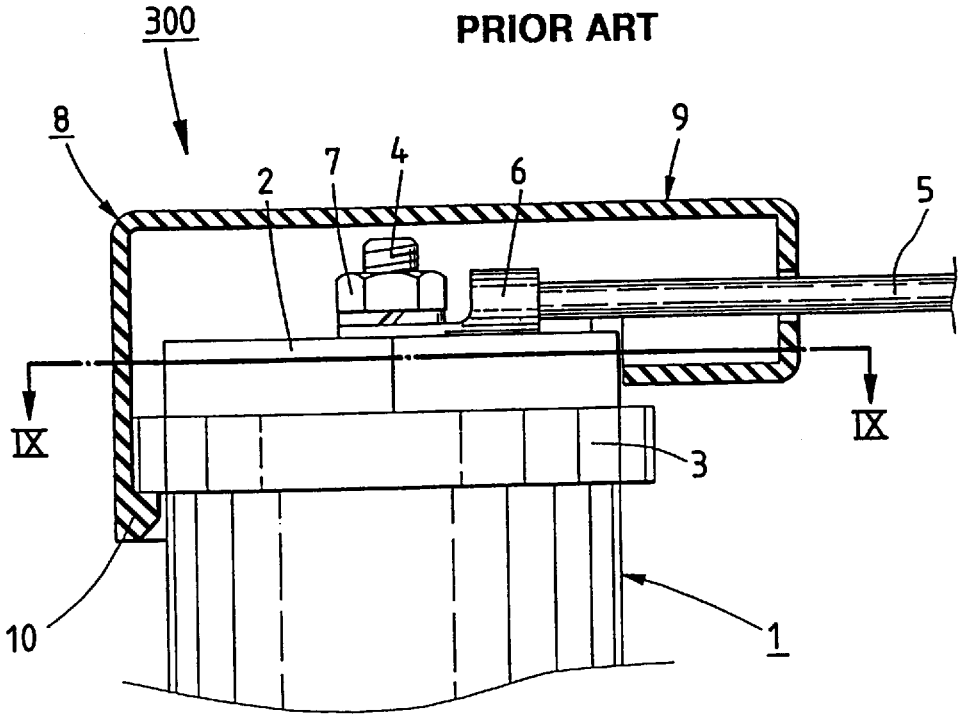
FIG. 8 PRIOR ART
FIG. 8 is a vertical sectional view showing a condition in which a conventional injector insulating cover is attached to an injector.
Figure 9:
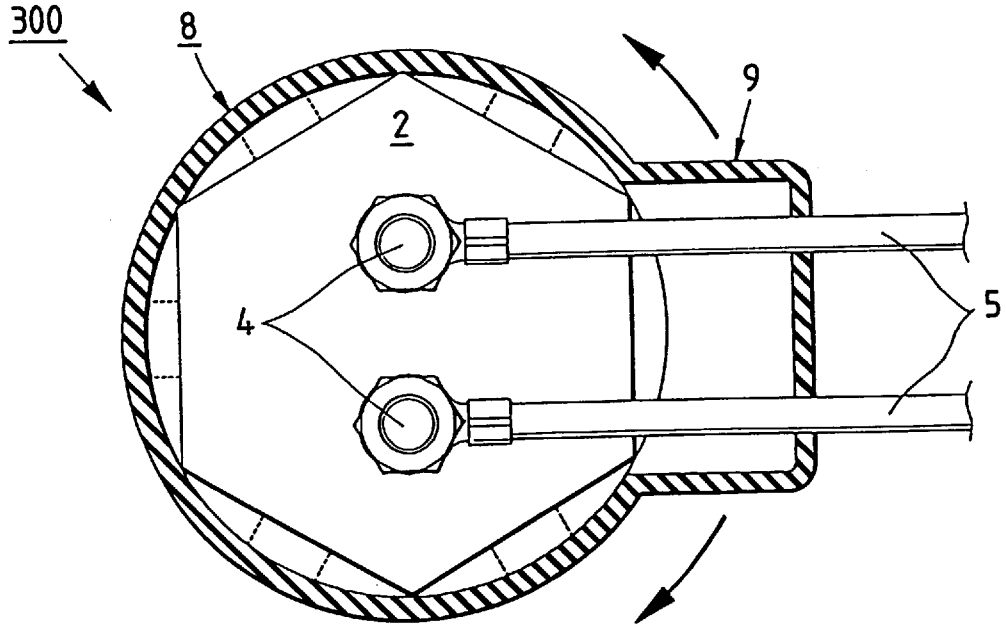
FIG. 9 PRIOR ART
FIG. 9 is a sectional view taken along a line IX—IX in FIG. 8.

Accordingly, as shown in FIG. 7, the circumferential engagement portion 50 formed in an inner wall portion of the insulating cover 200 is configured only by the corner portions 51 which can be surely fitted to the respective apexes 2*a* of the nut portion 2 of the injector 1. Even if a large external force is applied to the insulating cover 200, therefore, the insulating cover 200 will not rotate about the axis of the injector 1. Thus, the electric wires 5 connected to the injector 1 can be surely held so as to elongate in a desired direction.

It should be noted that the insulating terminal cover of the invention is not limited to the constructions of the injector insulating covers of the first and second embodiments, and various modifications can be performed.

In the above-described embodiments, in order to continuously provide the wire holding portion to the body portion of the injector insulating cover, the body portion is not constructed so as to be fitted to the head portion of the injector over the entire periphery in the circumferential direction. By modifying the shape of the wire holding portion, the body portion may be constructed so as to be fitted to the head portion of the injector over the entire periphery in the circumferential direction.

Also the cylindrical terminal body which is fastened and fixed to the portion to be mounted is not limited to the injector in the above-described embodiments, and the cover of the invention can be used for various types of cylinidrical terminal bodies.

As apparent from the above description, in the insulating terminal cover of the invention, the inner wall portion is engaged with the apexes of the outer periphery of the nut portion disposed in the head portion of the cylindrical terminal body. When the insulating terminal cover is attached so as to cover the head portion of the cylindrical terminal body, therefore, the insulating terminal cover cannot relatively rotate about the axis. Accordingly, an electric wire connected to the wire connecting portion of the cylindrical terminal body can be surely held so as to elongate in a desired direction.

Accordingly, irrespective of the leading conditions in the engine room and the like, disadvantages such as that the electric wire comes in contact with peripheral components and the insulating sheath are damaged can be surely prevented from being produced.

What is claimed is:

1. An insulating terminal cover which is to be attached to a head portion of a terminal body said terminal cover for covering a nut portion and a wire connecting portion in the head portion of the terminal body, said insulating terminal cover comprising:

a body portion for attaching to the head portion of the terminal body;

a wire holding portion integrated with said body portion and for holding a wire;

fitting portions provided in an inner wall portion of said body portion, said fitting portions formed by cut-out portions on the inner wall portion corresponding to apexes of an outer periphery of the nut portion for engaging with the nut portion so that a leading position of the wire is fixed with respect to the terminal body;

openings provided on a top wall portion of said body portion aligned with said fitting portions; and chamfers provided at peak portions of said fitting portions, said chamfers being brought into contact with side faces of the nut portion so that the leading position of the wire is fixed with respect to the terminal body.

2. An insulating terminal cover according to claim 1, further comprising a lower cover hinged to the wire holding portion for holding the wire, wherein said lower cover closes to form a wire holding hole.

3. An insulating terminal cover according to claim 1, further comprising engagement pawls protruding from the inner wall of the body portion for engaging with a lower face of a flange portion on the terminal body.

* * * * *